US006042123A

United States Patent [19]

Eck, Sr.

[11] Patent Number: 6,042,123

[45] Date of Patent: Mar. 28, 2000

[54] SUPER IN-LINE ROLLER SKATES

[76] Inventor: Herbert Eck, Sr., 59 Midland Lake Rd. Box 41, Middletown, N.Y. 10940

[21] Appl. No.: 08/908,785

[22] Filed: Aug. 8, 1997

[51] Int. Cl.[7] ..... A63C 17/06

[52] U.S. Cl. ..... 280/11.19; 280/11.19; 280/11.28; 280/11.22

[58] Field of Search ..... 280/11.19, 11.22, 280/11.23, 11.27, 11.28, 87.041, 87.042

[56] References Cited

U.S. PATENT DOCUMENTS

| | | | |
|---|---|---|---|
| 4,047,727 | 9/1977 | Holladay et al. . | |
| 5,183,276 | 2/1993 | Pratt | 280/11.22 |
| 5,251,920 | 10/1993 | McHale | 280/11.27 |
| 5,419,570 | 5/1995 | Bollotte . | |
| 5,560,625 | 10/1996 | Kuykendall | 280/11.22 |
| 5,566,956 | 10/1996 | DiWang . | |
| 5,566,958 | 10/1996 | Sinelnikov et al. | 280/11.22 |
| 5,697,622 | 12/1997 | Warinner | 280/11.22 |

FOREIGN PATENT DOCUMENTS

| | | | |
|---|---|---|---|
| 622 | 2/1876 | United Kingdom | 280/11.27 |

*Primary Examiner*—Richard M. Camby
*Attorney, Agent, or Firm*—Joseph L. Spiegel

[57] ABSTRACT

A rollerblade assembly includes a platform with an upper deck on which a rider stands and an underside, and an in-line roller wheel assembly mounted to the underside along a longitudinal centerline of the platform. Right and left wheel sets are removably mounted to the underside, in parallel side-by-side relationship to the inline roller wheel assembly and function as training wheels.

2 Claims, 2 Drawing Sheets

SUPER IN-LINE ROLLER SKATES

BACKGROUND OF THE INVENTION

1. Field of the Invention

The present invention relates generally to rollerblade assemblies and in particular to such assemblies with means for assisting in training in the use of the assembly.

2. Description of the Prior Art

The U.S. Pat. No. 4,047,727 to Holladay, et al describes a skateboard with a pair of roller wheel assemblies secured in longitudinally spaced relationship to the bottom surface of its elongated platform.

The U.S. Pat. No. 5,419,570 to Bollotte describes a skateboard with forward handle, upwardly turned rear portion and inline wheel assembly secured along a centerline to the bottom surface of its supporting platform.

The U.S. Pat. No. 5,566,956 to Di Wang, discloses a skateboard with forward toe abutment, rearward heel support platform and inline wheel assembly including front and rear wheels mounted in in-line relationship along a centerline to the bottom surface of its supporting platform.

SUMMARY OF THE INVENTION

An object of the present invention is a rollerblade assembly with improved balance.

Another object is a rollerblade assembly that allows for training of the rider during use.

These and other objects, features and advantages of the present invention are accomplished in accordance with the teachings of the present invention, one illustrative embodiment of which comprises a rollerblade assembly including a platform with an upper deck on which a rider stands and an underside, and an in-line roller wheel assembly mounted to the underside along a longitudinal centerline of the platform. Right and left wheel sets are removably mounted to the underside, in parallel side-by-side relationship to the inline roller wheel assembly and function as training wheels.

BRIEF DESCRIPTION OF THE DRAWING

Other objects, features and advantages of the invention will be apparent from the following detailed description and accompanying drawing, wherein.

DETAILED DESCRIPTION OF PREFERRED EMBODIMENT

Figure 1:
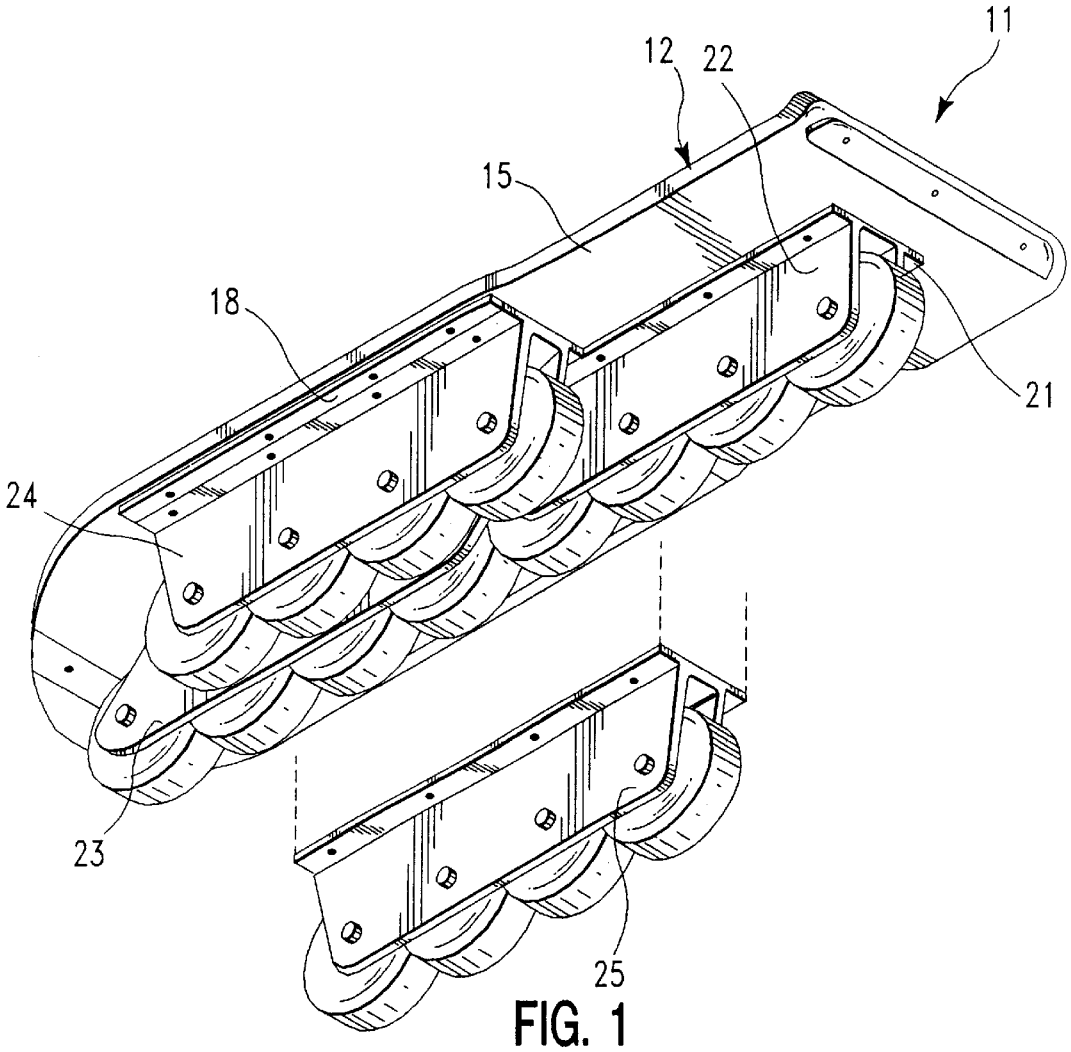
FIG. 1 is an underside perspective partly-exploded view of the novel roller blade assembly of the present invention with training wheel set shown detached.
Figure 2:
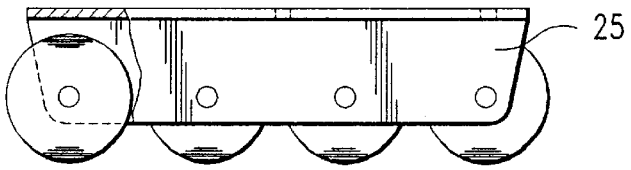
FIG. 2 is a side view, partly broken away of a training wheel set.
Figure 3:
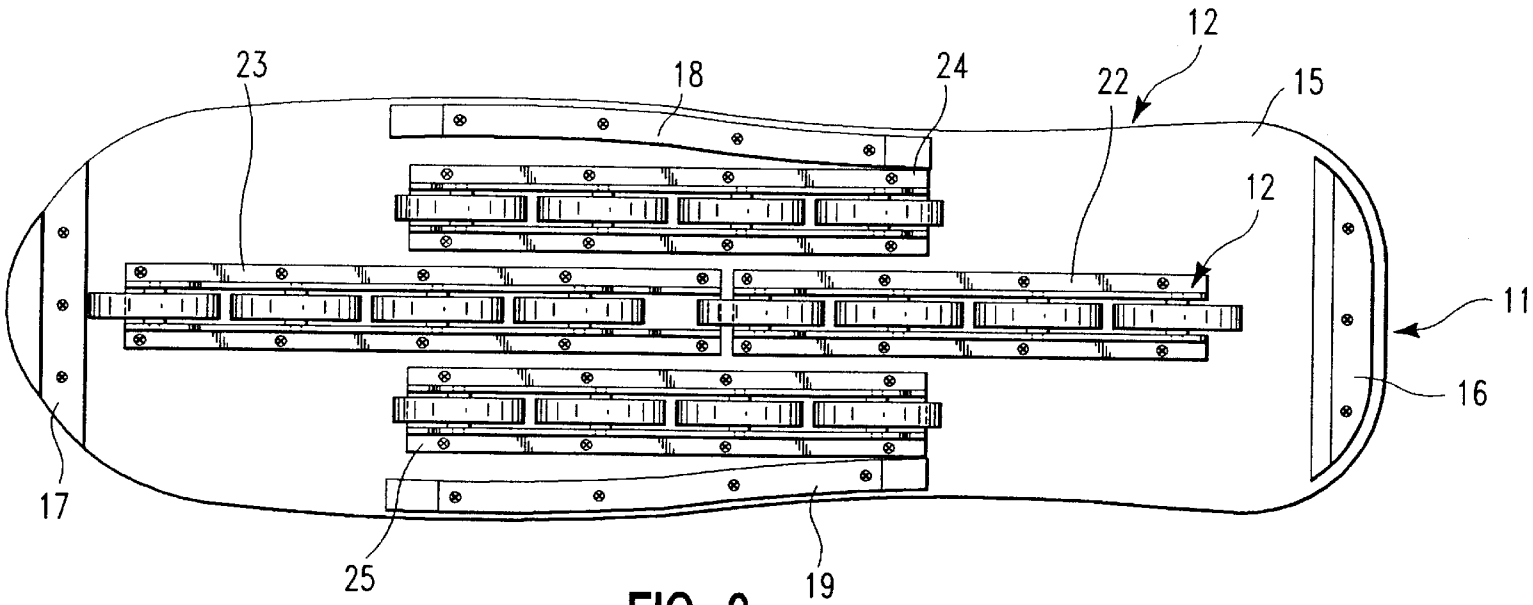
FIG. 3 is a bottom plan view of the rollerblade assembly of the present invention.
Figure 4:
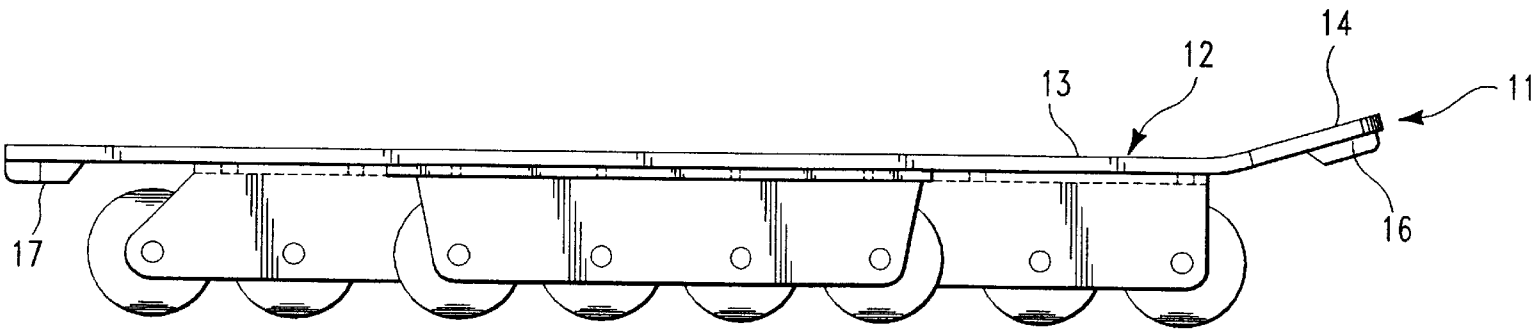
FIG. 4 is a side elevation view of the roller blade assembly of the present invention.

Referring now to the drawing, a rollerblade assembly 11 constructed in accordance with the teachings of the present invention is seen as including, a platform 12 with a deck or top surface 13 upon which a rider stands and from which he or she kicks off for propulsion and maneuvering. Platform 12 is typically constructed of durable plastic or wood, measures 30 inches in length and 10 inches in width and has an elevated front portion 14. Its deck may be decorated with an attractive graphic design.

Bottom surface or underside 15 of the platform includes plastic front 16, rear 17 and side bumpers, 18, 19.

The rollerblade assembly further includes a center wheel assembly 21 mounted to and along a centerline of the underside, and in the embodiment illustrated comprises a forward 22 and rearward 23 set of wheels, four wheels per set in the embodiment illustrated, the wheels spaced and arranged in in-line relationship.

Still further, the rollerblade assembly includes right 24 and left 25 wheel sets removably mounted to the underside and in parallel side-by-side, relationship to the center wheel assembly. In the embodiment illustrated, each wheel set includes four wheels spaced and arranged in in-line relationship.

In use, the rider employs the rollerblade assembly 11 in the usual manner. Right 24 and left 25 wheel sets, however, function as training wheels. When the rider has gained sufficient agility and confidence, the right and left wheel sets are removed.

It should be obvious that changes, additions and omissions may be made in the details and arrangement of parts without departing from the spirit and scope of the invention as defined in the appended claims.

What is claimed is:

1. An in-line roller skate assembly comprising:

an elongated platform having an upper deck on which a rider stands and an underside;

an in-line roller wheel assembly mounted to the underside along a longitudinal centerline of the platform; and, right and left wheel sets removable mounted to the underside and in parallel side-by-side relationship to the in-line roller wheel assembly, and wherein the right and left wheel sets include wheels spaced and arranged in in-line relationship.

2. The invention defined by claim 1 including front, rear and side bumpers mounted to the underside of the platform.

* * * * *